US008690020B1

(12) United States Patent
Murray

(10) Patent No.: US 8,690,020 B1
(45) Date of Patent: Apr. 8, 2014

(54) SELF-DEFENSE DEVICE

(76) Inventor: Lance T. Murray, Prescott, AZ (US)

( * ) Notice: Subject to any disclaimer, the term of this patent is extended or adjusted under 35 U.S.C. 154(b) by 0 days.

(21) Appl. No.: 13/528,531

(22) Filed: Jun. 20, 2012

Related U.S. Application Data

(60) Provisional application No. 61/499,551, filed on Jun. 21, 2011.

(51) Int. Cl.
*B67D 1/07* (2006.01)

(52) U.S. Cl.
USPC ..... 222/192; 222/30; 222/39; 222/3; 222/113; 222/153.13; 222/135; 222/402.1

(58) Field of Classification Search
USPC ..... 222/192, 78, 153.1, 153.13, 402.11, 222/402.13, 182, 129, 30, 39, 402.15, 222/135–136, 113, 3, 143; 362/96, 101, 362/109, 113; 102/367, 370; 239/304
See application file for complete search history.

(56) References Cited

U.S. PATENT DOCUMENTS 2,348,393 A * 5/1944 Krieger ..... 200/334
3,142,227 A * 7/1964 Stringer ..... 89/136
3,204,807 A * 9/1965 Ramsing ..... 220/242
3,635,372 A * 1/1972 Van Dyck et al. ..... 222/3
4,044,712 A * 8/1977 Goodman et al. ..... 116/142 FP
4,399,340 A * 8/1983 Crandall et al. ..... 200/334
4,449,474 A * 5/1984 Mariol ..... 116/2
5,005,736 A * 4/1991 Portas ..... 222/135
5,032,824 A * 7/1991 Corbin ..... 340/574
5,161,679 A * 11/1992 Russo ..... 200/43.17
5,169,029 A * 12/1992 Behar et al. ..... 222/1
5,373,427 A * 12/1994 McLean ..... 362/96
5,476,192 A * 12/1995 Julinot ..... 222/78
5,531,359 A * 7/1996 Winner ..... 222/153.11
5,549,220 A * 8/1996 Whalen ..... 222/1
5,839,461 A * 11/1998 Lambeth, Jr. ..... 135/72
5,893,483 A * 4/1999 Duran ..... 222/39
5,921,442 A * 7/1999 Keller et al. ..... 222/153.13
5,941,629 A * 8/1999 Tuscher ..... 362/253
5,988,450 A * 11/1999 Cassarino ..... 222/192
6,052,051 A * 4/2000 Whalen ..... 340/425.5
6,237,461 B1 * 5/2001 Poole ..... 89/1.11
6,439,432 B1 * 8/2002 Park ..... 222/113
6,644,505 B2 * 11/2003 Davidian ..... 222/1
7,021,499 B2 * 4/2006 Hansen et al. ..... 222/145.5
7,100,602 B2 * 9/2006 Cole et al. ..... 128/200.14
7,121,432 B2 * 10/2006 Kostal et al. ..... 222/192
7,394,031 B2 * 7/2008 Lee ..... 200/43.01

(Continued)

*Primary Examiner* — Paul R Durand
*Assistant Examiner* — Randall Gruby
(74) *Attorney, Agent, or Firm* — Schmeiser, Olsen & Watts LLP

(57) ABSTRACT

A self-defense device is disclosed. The self-defense device includes an alert unit which alerts others to danger when activated. The self-defense device also includes a defense unit which can be used to disable or repel an attacker when activated. In a particular embodiment the alert unit is an air horn. In a particular embodiment the defense unit is a canister of self-defense aerosol spray. The self-defense device can include a coupling device which couples the defense unit to the alert unit. The self-defense device also includes a trigger which activates both the alert unit and the defense unit. The trigger has an ON state and an OFF state. The trigger can include a first trigger portion, a second trigger portion, and a trigger portion coupler. The trigger is coupled to the coupling device in some embodiments.

13 Claims, 13 Drawing Sheets

(56) References Cited

U.S. PATENT DOCUMENTS

| | | | | |
|---|---|---|---|---|
| 7,526,998 | B2 * | 5/2009 | Vasel et al. | 102/502 |
| 7,787,232 | B2 * | 8/2010 | Abatemarco | 361/232 |
| 2004/0238567 | A1 * | 12/2004 | Bloc | 222/135 |
| 2007/0194048 | A1 * | 8/2007 | Teig | 222/113 |
| 2008/0173257 | A1 * | 7/2008 | Steiner et al. | 119/796 |
| 2010/0025427 | A1 * | 2/2010 | Chiou et al. | 222/1 |

* cited by examiner

Trigger 230 in OFF state

Trigger 230 in ON state

SELF-DEFENSE DEVICE

CROSS REFERENCE TO RELATED APPLICATION

This application claims priority to U.S. Provisional Patent Application to Lance T. Murray entitled "Self-Defense Device," Ser. No. 61/499,551 filed Jun. 21, 2011, the disclosure of which is hereby incorporated entirely herein by reference.

BACKGROUND OF THE INVENTION

1. Technical Field

This invention relates generally to self-defense devices and in particular to a device that provides both a defense unit for defending against an attack, and an alert unit for alerting others of the emergency.

2. State of the Art

Individuals often carry self-defense devices to protect themselves from attack from dangerous humans or animals. Some individuals carry weapons for self-defense. Carrying weapons for self-defense has many legal and safety risks, however, and so it is desirable to have a self-defense device which is less dangerous. Canisters of self-defense aerosol spray have become popular self-defense items. Self-defense aerosol repellent sprays such as tear gas or pepper spray are strong enough to stop an attacker from causing harm, and yet not strong enough to permanently disable or kill another individual. Thus canisters of self-defense aerosol spray provide a less dangerous self-defense alternative to weapons.

However, while canisters of self-defense aerosol spray can ward off or disable attackers, they do not provide an alert device capability. An alert device is a device which draws attention to oneself, in the hope that if an individual is being attacked, others will be alerted and can come and help. One alert option is to carry a whistle or alarm that makes a loud noise in the presence of danger. The whistle or alarm will attract attention and hopefully help will arrive. Often a potential attacker will flee when there is the potential to draw a crowd, and if this does not occur, then the others that are drawn can help to capture or deter the attacker. But—if an individual wants to use the aerosol repellent spray and also alert others to the dangerous situation, then two devices must be carried. It is not practical to carry more than one device that needs to be activated in an emergency. Thus, it is desirable to have a self-defense device which provides both an alert function and an attacker disabling function in one device, which is easy to carry and operate, and where both functions can be activated with a single trigger.

DISCLOSURE OF THE INVENTION

The disclosed invention relates to self-defense devices and in particular to a device that provides both a defense unit for defending against an attack, and an alert unit for alerting others of the emergency.

Disclosed is a self-defense device that includes a trigger. The trigger has an ON state and an OFF state. The self-defense device includes an air horn, where the air horn is activated in response to the trigger being in the ON state. The air horn produces a noise in response to being activated. The self-defense device also includes a self-defense aerosol spray unit, where the self-defense aerosol spray unit is activated in response to the trigger being in the ON state. The self-defense device releases a stream of self-defense aerosol in response to being activated. Both the air horn and the self-defense aerosol spray unit are activated in response to the trigger being in the ON state. In some embodiments the self-defense device includes a coupling device, where the coupling device couples the air horn to the self-defense aerosol spray unit. In some embodiments the coupling device includes a nozzle, where the stream of self-defense aerosol is sprayed from the nozzle. In some embodiments the coupling device holds a horn bell, where the air horn noise is produced from the horn bell. In some embodiments the coupling device includes a trigger guard, where the trigger guard swings on an axle to move from an engaged state to a disengaged state, and where the trigger guard prevents the trigger from being placed in the ON state in response to the trigger guard being in an engaged state.

In some embodiments the horn bell directs the noise in a predetermined direction, and the nozzle sprays self-defense aerosol in the predetermined direction. In some embodiments the self-defense device includes a canister of marking material aerosol, where the canister of marking material aerosol sprays a stream of marking material in the predetermined direction in response to the trigger being in the ON state. In some embodiments the trigger includes a first trigger portion, where the first trigger portion places the self-defense aerosol spray unit in the ON state in response to the first trigger portion receiving pressure. In some embodiments the trigger includes a second trigger portion, where the second trigger portion places the air horn in the ON state in response to the first trigger portion receiving pressure. In some embodiments the trigger includes a trigger portion coupler, where the trigger portion coupler mechanically couples the first trigger portion to the second trigger portion. In some embodiments the second trigger portion includes a semi-annular ring coupled to the trigger portion coupler, where the semi-annular ring includes a first tab and a second tab coupled to the semi-annular ring. The first and the second tab place the air horn in the ON state in response to the first trigger portion receiving pressure. In some embodiments the second trigger portion includes a lever mount coupled to the semi-annular ring, where the lever mount couples the trigger to the coupling device.

A self-defense device is disclosed which includes a defense unit, an alert unit, a coupling device, and a trigger that activates both the defense unit and the alert unit. The coupling device couples the defense unit to the alert unit. In some embodiments the defense unit is a canister of self-defense aerosol spray. In some embodiments the defense unit is an electronic discharge self-defense device. In some embodiments the alert unit includes an air horn. In some embodiments the alert unit includes a strobe light. In some embodiments the self-defense device also includes a canister of marking material aerosol, which sprays marking material when activated by the trigger. In some embodiments the self-defense spray includes marking material. In some embodiments the trigger includes a first trigger portion, a second trigger portion, a trigger portion coupler, and a lever mount. The first trigger portion activates the defense unit. The second trigger portion activates the alert unit. The trigger portion coupler couples the second trigger portion to the first trigger portion. The lever mount is inserted into a lever mount hole in the coupling device. In some embodiments the coupling device includes a camera, where the trigger activates the camera.

A method of forming a self-defense device is disclosed which includes the step of coupling an air horn to a self-defense aerosol spray unit, wherein the air horn directs sound into a particular direction, and where the self-defense aerosol spray unit sprays aerosol into the same direction. The method also includes the step of coupling a trigger to the self-defense device such that the trigger activates both the air horn and the self-defense aerosol spray unit.

A method of forming a self-defense device is disclosed that includes the steps of coupling an air horn to a coupling device, coupling a canister of self-defense aerosol spray to the coupling device, and coupling a trigger to the coupling device, where the trigger activates both the air horn and the canister of self-defense aerosol spray. In some embodiments the step of coupling an air horn to a coupling device includes the step of coupling an air horn to a coupling device such that the air horn directs noise into a predetermined direction in response to the air horn being activated. In some embodiments the method includes the step of coupling a camera to the coupling unit, where the trigger activates the camera. In some embodiments the method includes the step of forming a trigger. In some embodiments the step of forming a trigger includes the steps of forming a trigger first portion, forming a trigger second portion, and forming a trigger portion coupler, where the trigger portion coupler couples the second trigger portion to the first trigger portion. In some embodiments forming a second trigger portion includes the step of forming a semi-annular ring, where the semi-annular ring is coupled to the trigger portion coupler. In some embodiments forming a second trigger portion includes the step of forming a first tab, where the first tab is coupled to the semi-annular ring. In some embodiments forming a second trigger portion includes the step of forming a second tab, where the second tab is coupled to the semi-annular ring. In some embodiments forming a second trigger portion includes the step of forming a lever mount, where the lever mount is coupled to the semi-annular ring, and where the lever mount couples the trigger to the coupling device.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to self-defense devices and in particular to a device that provides both a defense unit for defending against an attack, and an alert unit for alerting others of the emergency.

Figure 1:
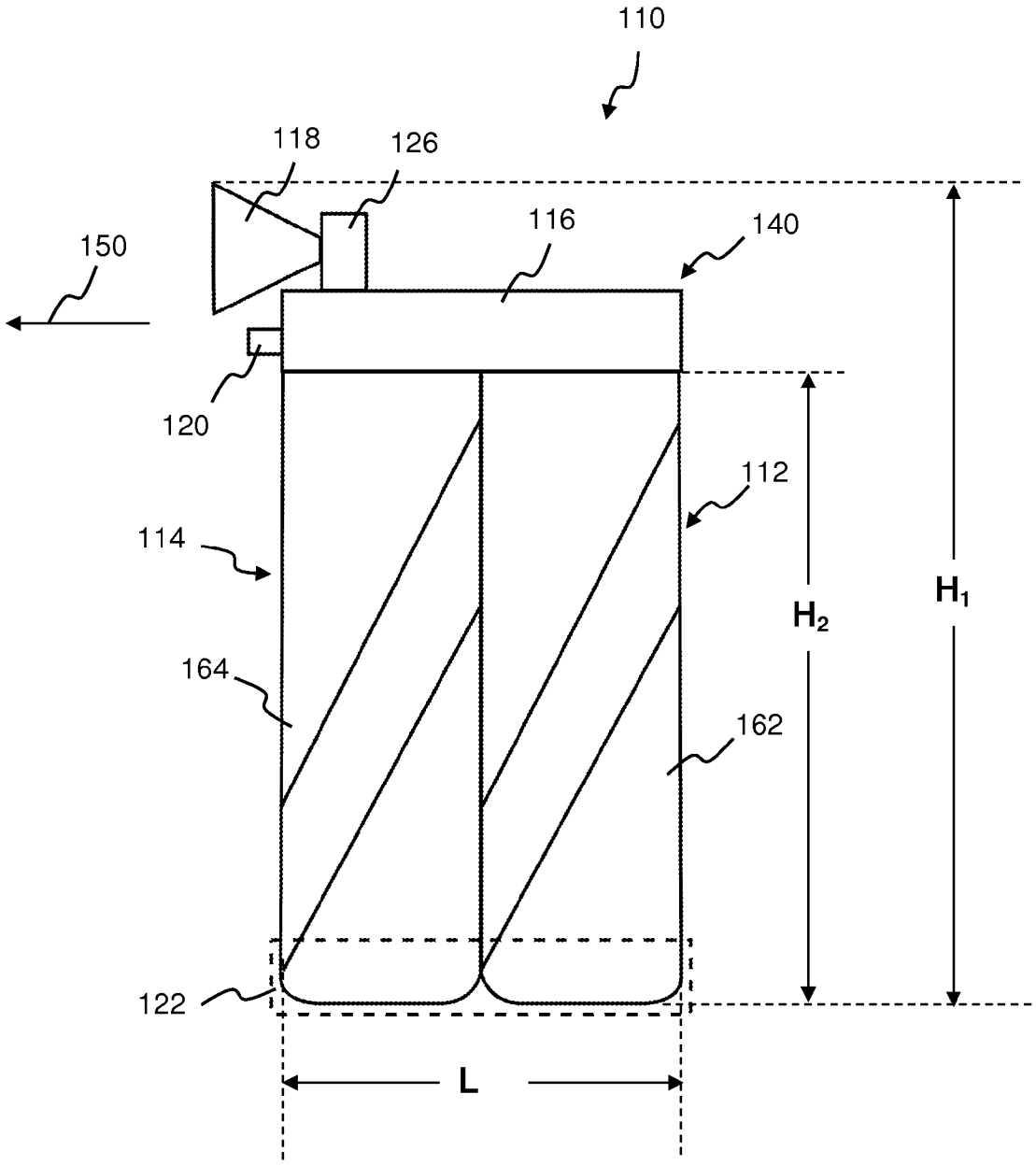
FIG. 1 shows a side view of an embodiment of self-defense device 110 according to the invention.
Figure 2:
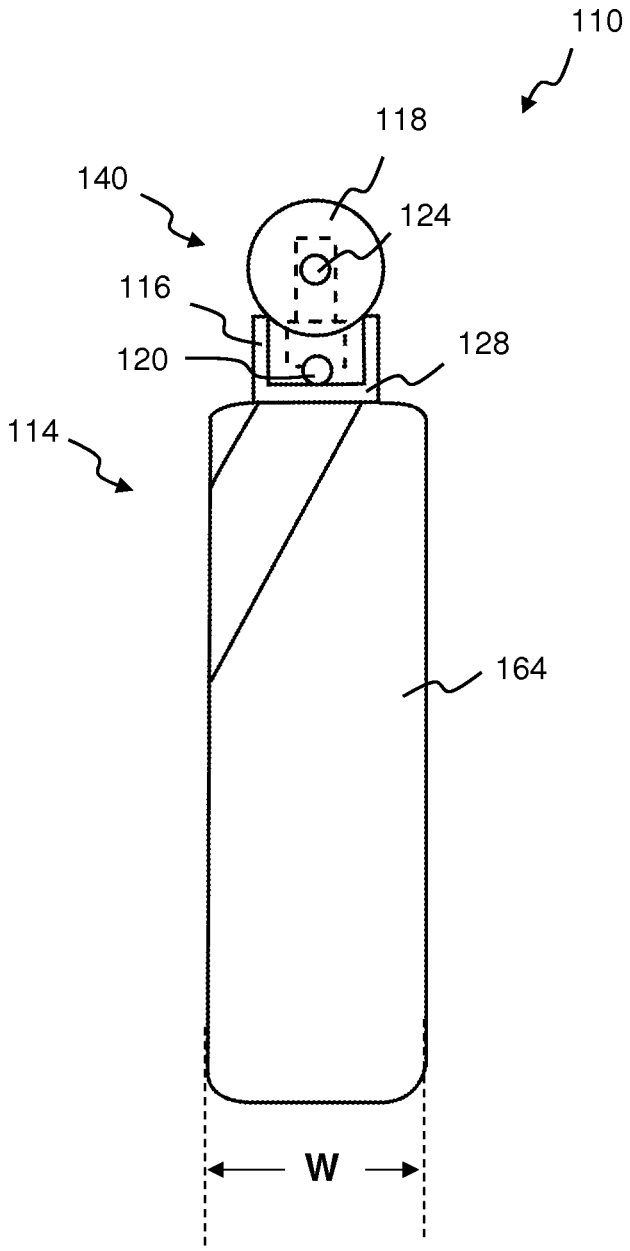
FIG. 2 shows a front view of self-defense device 110 of FIG. 1.
Figure 3:
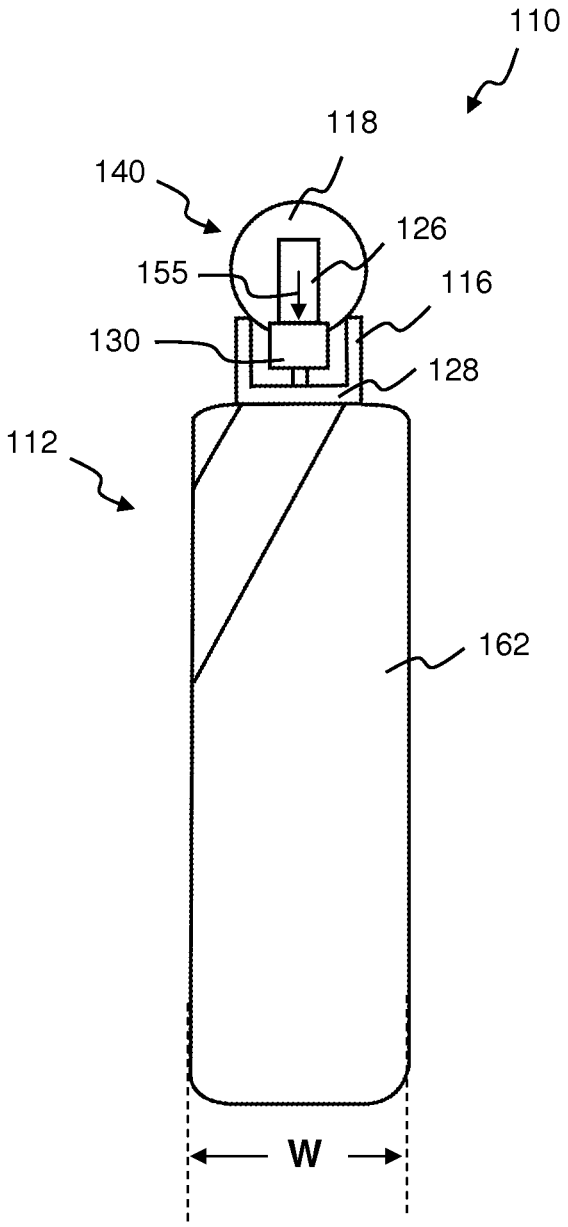
FIG. 3 shows a back view of self-defense device 110 of FIG. 1.

FIG. 1 is a side view of on embodiment of self-defense device 110 according to the invention. FIG. 2 is a front view of self-defense device 110 of FIG. 1. FIG. 3 is a rear view of self-defense device 110 of FIG. 1. Self-defense device 110 includes defense unit 112 and alert unit 114. Self-defense device 110 also includes trigger 130 (see FIG. 3) which activates both defense unit 112 and alert unit 114. Trigger 130 has an ON state and an OFF state. Defense unit 112 is activated in response to trigger 130 being in the ON state. Alert unit 114 is activated in response to trigger 130 being in the ON state. In the embodiment shown in FIG. 1 through FIG. 3, alert unit 114 is air horn 114. Air horn 114 produces a noise in response to trigger 130 being in the ON state. In the embodiment shown in FIG. 1 through FIG. 3, defense unit 112 is self-defense aerosol spray unit 112. self-defense spray unit 112 sprays a stream of self-defense aerosol in response to trigger 130 being in the ON state.

Defense unit 112 is a defense device that acts to repel or disable an attacker. A defense unit is used to cause bodily discomfort or harm to an attacker so that the attack ceases. Defense unit 112 in this embodiment is self-defense aerosol spray unit 112 that includes canister 162 of self-defense aerosol. Self-defense aerosol can be tear gas, pepper spray, or other spray aerosol which repels an attacker. In some embodiments there are other ingredients mixed in with the spray repellent, such as a propellant. Defense unit 112 sprays a stream of self-defense aerosol when defense unit 112 is activated. Defense unit 112 is activated by trigger 130. Trigger 130 has an ON state and an OFF state. Defense unit 112 is activated in response to trigger 130 being in the ON state. In some embodiments a marking material is mixed in with the spray repellent mixture. Marking material is a material that can "mark" the attacker. Marking material can be a paint or dye or other similar material that can be used to identify who the attacker is. In this embodiment the marking material would be sprayed with the spray repellent. In some embodiments defense unit 112 is another type of defense unit. Defense unit 112 can be a device which uses electricity to repel or disable an attacker, such an electronic discharge self-defense device. Defense unit 112 can be a device which mechanically repels or disables an attacker. In some embodiments defense unit 112 is another type of device which repels or disables an attacker. Defense unit 112 can be any device that operates to stop an attacker from continuing an attack.

Alert unit 114 is an alert device that provides notification to others that an emergency is occurring. An alert unit is used to draw others to the scene of an attack or other emergency. Making a noise is a very common way to alert others to danger. Alert unit 114 is often some type of noise generator that uses noise to alert others to an emergency or attack. In this embodiment alert unit 114 is an air horn which uses compressed air from canister 164 to make a loud horn sound. Alert unit 114 produces a noise when alert unit 114 is activated. Alert unit 114 is activated by trigger 130. Trigger 130 has an ON state and an OFF state. Alert unit 114 is activated in response to trigger 130 being in the ON state. Often alert unit 114 will act to scare away an attacker because the attacker does not want to be caught by others. In this embodiment alert unit 114 is air horn 114 that blasts a loud noise when alert unit 114 is activated. Air horn 114 in this embodiment includes canister 164 of compressed air. In some embodiments alert unit 114 is another type of noise-making device. Alert unit 114 can also use light instead of noise, or in addition to noise, to alert others of a dangerous situation. In some embodiments alert unit 114 is a strobe light. In some embodiments alert unit 114 is an electronic device which sends an electromagnetic alert signal that can be received by others. Alert unit 114 can be any device that emits, send, or conveys an alert message to others informing them that help is needed.

Self-defense device 110 includes trigger 130. Trigger 130 according to the invention activates both defense unit 112 and alert unit 114. In some embodiments trigger 130 activates defense unit 112 and alert unit 114 simultaneously. Trigger 130 can be many different types of triggering mechanisms. Trigger 130 has at least two states, an "ON" state, and an "OFF" state (See FIG. 8 through FIG. 10 for an embodiment of trigger 230 according to the invention). When trigger 130 is in the OFF state, neither defense unit 112 nor alert unit 114 is active. Self-defense device 110 is stored and carried with trigger 130 in the OFF state.

When trigger 130 is in the ON state, both defense unit 112 and alert unit 114 are activated. Defense unit 112 is activated in response to trigger 130 being in the ON state. In this embodiment self-defense aerosol spray unit 112 sprays a stream of self-defense aerosol from canister 162 out of nozzle 120 in direction 150 when trigger 130 is in the ON state. Self-defense aerosol spray unit 112 is in an activated state when it is spraying self-defense aerosol out of nozzle 120. The self-defense aerosol sprayed by self-defense aerosol spray unit 112 can be tear gas, pepper spray, or other aerosol repellent or deterrent. Self-defense aerosol spray unit 112 is activated (sprays the self-defense aerosol) in response to trigger 130 being in the ON state.

Alert unit 114 is activated in response to trigger 130 being in the ON state. In this embodiment air horn 114 is activated in response to trigger 130 being in the ON state. When air horn 114 is activated, compressed air is released from air horn orifice 124, making a loud horn blast sound. Horn bell 118 directs the horn blast sound in direction 150. Thus air horn 114 produces a noise in direction 150 in response to trigger 130 being in the ON state.

Trigger 130 can be many different types of triggering mechanisms with an ON state and an OFF state. In this embodiment trigger 130 is a pressure-activated trigger that is in an OFF state when it does not have pressure applied. When pressure 155 (see FIG. 3) is put on trigger 130, pushing trigger 130 down towards canisters 162 and 164, trigger 130 is placed in an ON state, which activates alert unit 114 and defense unit 112. In this embodiment trigger 130 stays in an ON state as long as pressure 155 remains on trigger 130. Pressure 155 is usually applied with a finger on the top of trigger 130. When pressure 155 is released, trigger 130 returns to an OFF state in this embodiment. Trigger 130 can be engaged in many other different ways, depending on the type of trigger 130 used. In some embodiments trigger 130 is put in an ON state with pressure, and then stays in the ON state even when the pressure is removed. In some embodiments trigger 130 requires pressure in another direction to move trigger 130 from an ON state to an OFF state.

In the embodiment shown in FIG. 1 through FIG. 3, trigger 130 is a mechanical trigger. In some embodiments trigger 130 is an electrical trigger. Trigger 130 can be any type of triggering mechanism with at least two states, an ON state and an OFF state, where alert unit 114 and defense unit 112 are activated in response to trigger 130 being in the ON state.

Trigger 130 of self-defense device 110 is placed in the ON state when an attack or other emergency occurs. If the user of self-defense device 110 is being attacked, the user can hold self-defense device 110 such that direction 150 is pointing at the attacker, and place trigger 130 in the ON state. Self-defense aerosol spray unit 112 will spray a stream of self-defense aerosol in direction 150, which will disable or deter the attacker from continuing the attack. Air horn 114 will direct a horn blast noise in direction 150, which will startle the attacker, and draw attention from others so that the attacker will be unable or unwilling to continue the attack. The combination of the self-defense aerosol directed at the attacker and the air horn attracting attention is intended to stop the attack.

Self-defense device 110 is sized to be hand-held. Self-defense device 110 according to the invention can be many different sizes. Self-defense device 110 of FIG. 1 through FIG. 3 has height $H_1$, length L, and width W. In this embodiment height $H_1$ is about 3½ inches, length L is about 2½ inches, and width W is about 1¼ inches. In some embodiments height $H_1$ is about 4½ inches, length L is about 2½ inches, and width W is about 1¼ inches. In some embodiments self-defense device 110 has other dimensions.

Self-defense device 110 according to the invention can be formed of one integral unit which includes canisters 162 and 164, one for defense unit 112 and one for alert unit 114. In some embodiments self-defense device 110 includes one canister with two separate chambers. One chamber can hold aerosol spray repellent for defense unit 112, for example, and the other can hold compressed air for air horn 114. Or, self defense device 110 can include two separate units, self-defense unit 112 and alert unit 114, that are coupled together and share the same trigger 130. In some embodiments canister 162 and/or canister 164 can be off-the-shelf canisters of spray repellent or compressed air that are bought separately and then coupled together to create self-defense device 110. In some embodiments canisters 162 and/or 164 are disposable. In the embodiment shown in FIG. 1 through FIG. 3, self-defense device 110 includes air horn 114 which includes canister 164 of compressed air, and self-defense aerosol spray unit 112, which includes canister 162 of a type of self-defense spray aerosol, as discussed earlier. In this embodiment canisters 162 and 164 are metal and formed separate from one another. Canisters 162 and 164 in this embodiment have a height $H_2$ and a width, W. In this embodiment both metal canisters 162 and 164 have a height $H_2$ which is about 2 inches, and a width W which is about 1¼ inches. In some embodiments both metal canisters 162 and 164 have a height $H_2$ which is about 2 inches. In some embodiments metal canisters 162 and 164 have other dimensions.

In some embodiments alert unit 114 includes a canister 164 made from a material other than metal. In some embodiments alert unit 114 includes elements other than canister 164 of compressed air. In some embodiments alert unit 114 has other dimensions. In some embodiments alert unit 114 is an electronic noise generating device. In some embodiments alert unit 114 is a different type of noise generating device. In some embodiments alert unit 114 is a light strobe. In some embodiments alert unit 114 is a light-generating device.

In some embodiments defense unit 112 includes a canister 162 made from a material other than metal. In some embodiments defense unit 112 includes elements other than canister 162 of self-defense aerosol. In some embodiments defense unit 112 has other dimensions. In some embodiments defense unit 112 provides defense in a way other than spraying self-defense aerosol.

Self defense device 110 according to the invention of FIG. 1 through FIG. 3 includes a separate defense unit 112 and alert unit 114, that are coupled together with coupling device 140. In the embodiment shown in FIG. 1 through FIG. 3, coupling device 140 couples alert unit 114 to defense unit 112, holds trigger 130, and directs the air horn noise and the self-defense aerosol spray when defense unit 112 and alert unit 114 are activated. In some embodiments defense unit 112 is removably coupled to coupling unit 140. In some embodiments alert unit 114 is removably coupled to coupling device 140.

Coupling device 140 in the embodiment shown in FIG. 1 through FIG. 3 includes coupling piece 128, trigger guard 116, nozzle 120, orifice 124, air horn bell 118, and horn bell mount 126. Coupling piece 128 couples canisters 162 and 164 to top coupling device 140. Coupling piece 128 holds compressed air canister 164 and canister of self-defense aerosol 162 adjacent to one another as shown in the drawings. Coupling piece 128 couples to the top of both canisters 162 and 162. In some embodiments defense unit 112 is removably coupled to coupling piece 128. In some embodiments alert unit 114 is removably coupled to coupling device 140. In some embodiments canister 162 is removably coupled to coupling piece 128. In some embodiments canister 164 is removably coupled to coupling device 140. Coupling piece 128 in this embodiment holds trigger 130.

Coupling device 140 in the embodiment shown in FIG. 1 through FIG. 3 includes nozzle 120. Nozzle 120 is the outlet which sprays a stream of self-defense spray aerosol when canister of self-defense spray 112 is activated. Nozzle 120 sprays self-defense aerosol in direction 150 in this embodiment. Coupling piece 128 includes the aerosol outlet tube which directs self-defense aerosol from canister of self-defense aerosol 162 to nozzle 120 when self-defense unit 112 is activated.

Coupling device 140 in this embodiment includes orifice 124, horn bell 118, and horn bell mount 126. Orifice 124 is the outlet for the horn blast made by compressed air when air horn 114 is activated. Coupling piece 128 includes the air outlet tube which directs compressed air from canister 164, through horn bell mount 126 to orifice 124 when air horn 114 is activated. Horn bell 118 directs the horn blast in direction 150 when air horn 114 is activated by putting trigger 130 in the ON state.

Coupling device 140 in this embodiment also includes trigger guard 116. Trigger guard 116 runs along either side of trigger 130 and protects trigger 130 from getting bumped, broken, or accidentally put in an ON state. In this embodiment trigger guard 116 runs length L along each side of self-defense device 110 on either side of trigger 130. Trigger guard 116 surrounds trigger 130 on two sides so that access to trigger 130 is restricted to the top side of trigger 130.

Coupling device 140 in this embodiment positions nozzle 120 and horn bell 118 so that both the horn blast noise from air horn 114 and the self-defense aerosol spray from self-defense aerosol spray unit 112 are directed in predetermined direction 150. In this embodiment both the horn blast noise and the stream of aerosol spray are directed in the same predetermined direction so they both can be simultaneously directed towards an attacker.

In the embodiment shown in FIG. 1 through FIG. 3, coupling device 140 is 1½ inches high. In some embodiments coupling device 140 is other sizes and configurations. In some embodiments coupling device 140 includes other structures or devices. See FIG. 5 through FIG. 10 for embodiment of self-defense device 210 with an embodiment of coupling device 140 according to the invention.

Some embodiments of self-defense device 110 include optional bottom coupling device 122, as shown in dotted lines in FIG. 1. Bottom coupling device 122 holds the bottoms of canister 162 and 164 in place in some embodiments. In some embodiments bottom coupling device 122 has other purposes. In some embodiments bottom coupling device 122 includes other elements or devices.

In some embodiments self-defense device 110 includes other items that can assist in self-defense. In some embodiments self-defense device 110 includes a marking unit that sprays paint, dye, colorant, or other marking material. A marking unit is used to apply the marking material to the attacker so the attacker can later be identified. In some embodiments the marking unit is an additional element of self-defense device 110 that is activated by placing trigger 130 in the ON state. In some embodiments the marking unit sprays marking material in direction 150 in response to trigger 130 being in the ON state. In some embodiments the colorant or other marking material is mixed in with the self-defense aerosol so that both are sprayed from nozzle 120 when trigger 130 is placed in the ON state. In some embodiments self-defense device 110 includes a camera that is activated when trigger 130 is placed in the ON state. The camera can be used to capture an image of an attacker, for instance.

Figure 4:
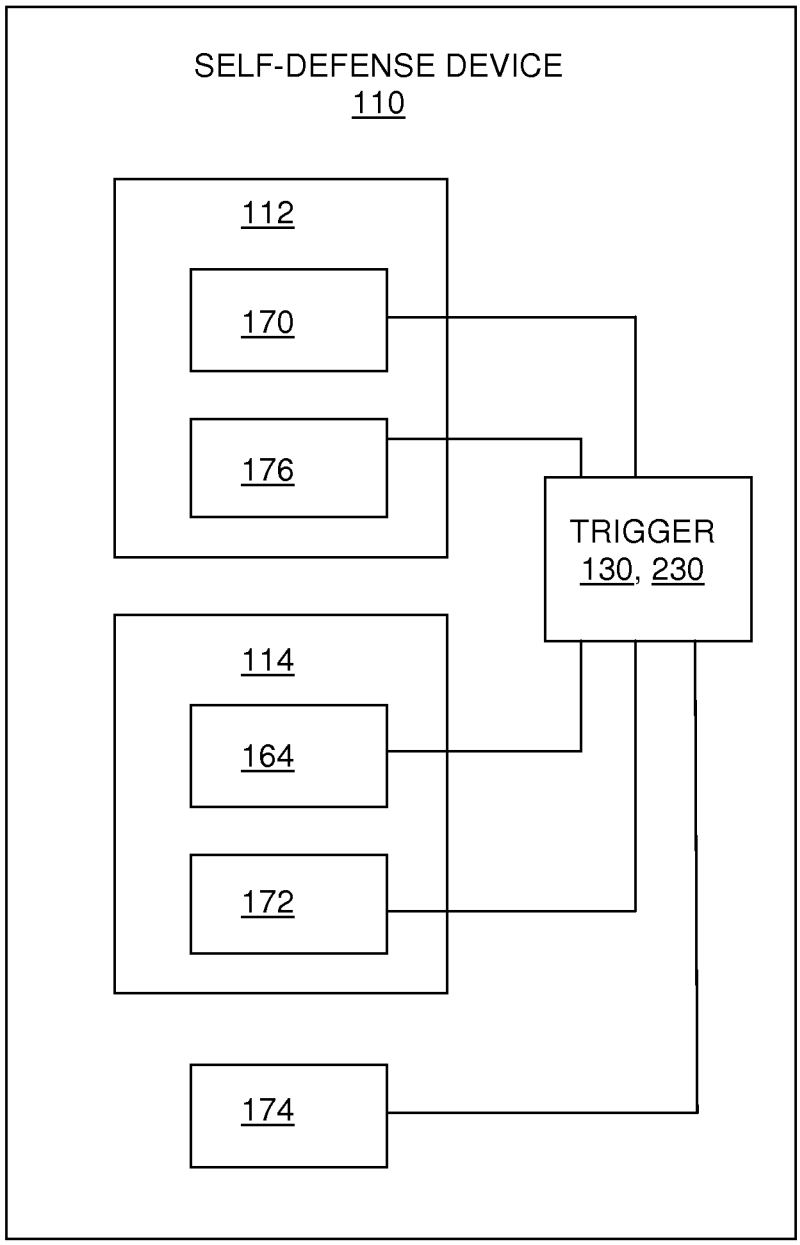
FIG. 4 shows a block diagram of an embodiment of self-defense device 110.

FIG. 4 shows a block diagram of an embodiment of self-defense device 110. In this embodiment self-defense device 110 includes defense unit 112, alert unit 114, camera 174, and trigger 130 (or trigger 130 can be replaced with trigger 230, see FIG. 5 through FIG. 10, or any other trigger according to the invention). Trigger 130 of self-defense device 110 activates camera 174 as well as self-defense unit 112 and alert unit 114. Self-defense unit 112 in the embodiment shown in FIG. 4 includes electronic discharge self-defense device 170 and canister of marking material 176. Electronic discharge self-defense device 170 and canister of marking material 176 are both activated by trigger 130. Electronic discharge self-defense device 170 can be used to disable an attacker using electronic pulses, and canister of marking 176 material can be used to mark an attacker.

Alert unit 114 in the embodiment shown in FIG. 4 includes canister of compressed air 164 and strobe light 172. Canister of compressed air 164 and strobe light 172 are both activated by trigger 130. Canister of compressed air 164 can be used to make a noise as described above, and strobe light 172 can be used to attract attention and/or distract an attacker. Camera 174 is also activated by trigger 130, and can be used to capture images or video of an attack and/or an attacker.

Figure 5:
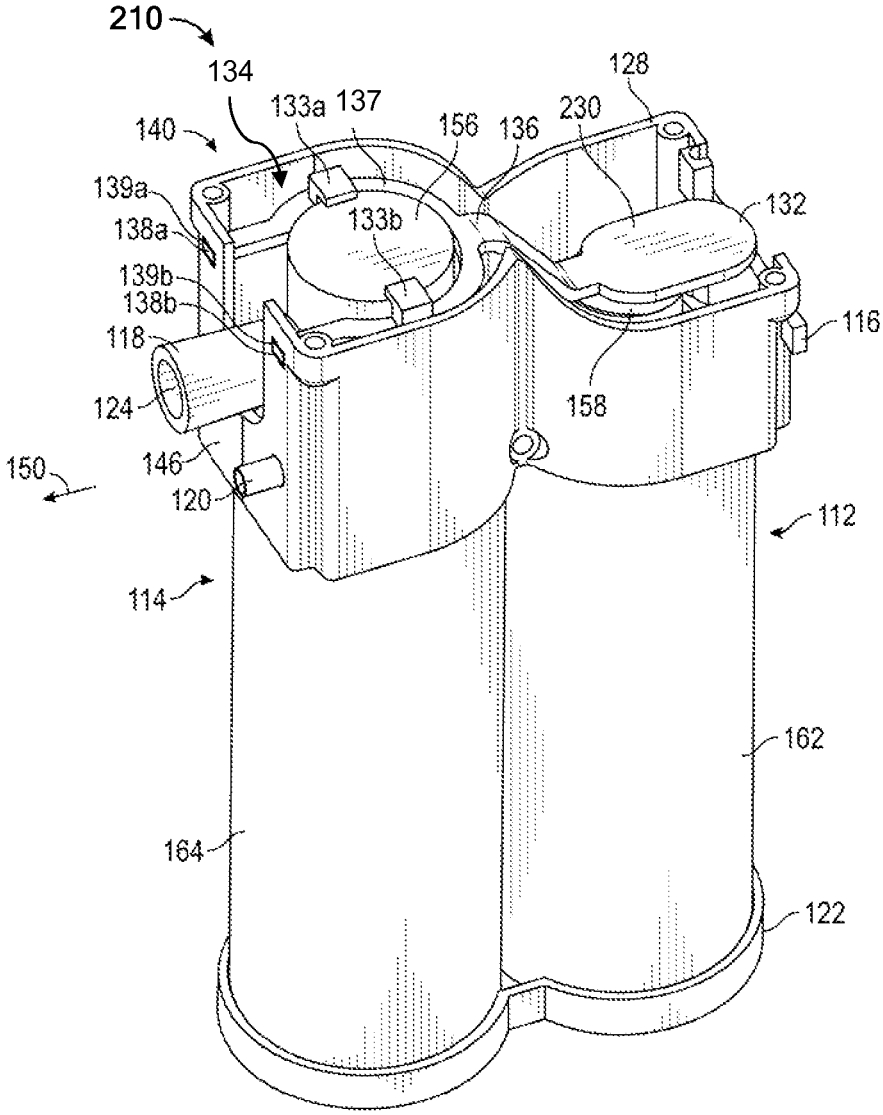
FIG. 5 shows a perspective view of an embodiment of self-defense device 210 according to the invention, with coupling piece cover 144 removed.
Figure 6:
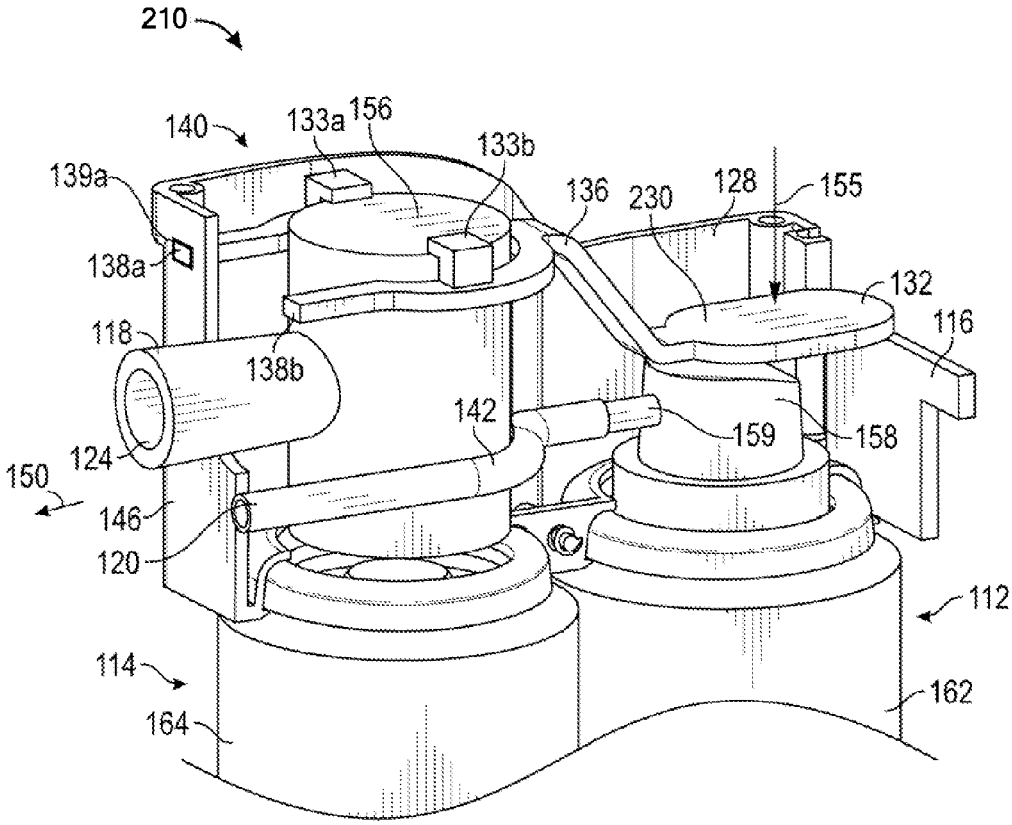
FIG. 6 shows a perspective view of a portion of self-defense device 210 of FIG. 5, with a portion of coupling device 140 cut-away.
Figure 7:
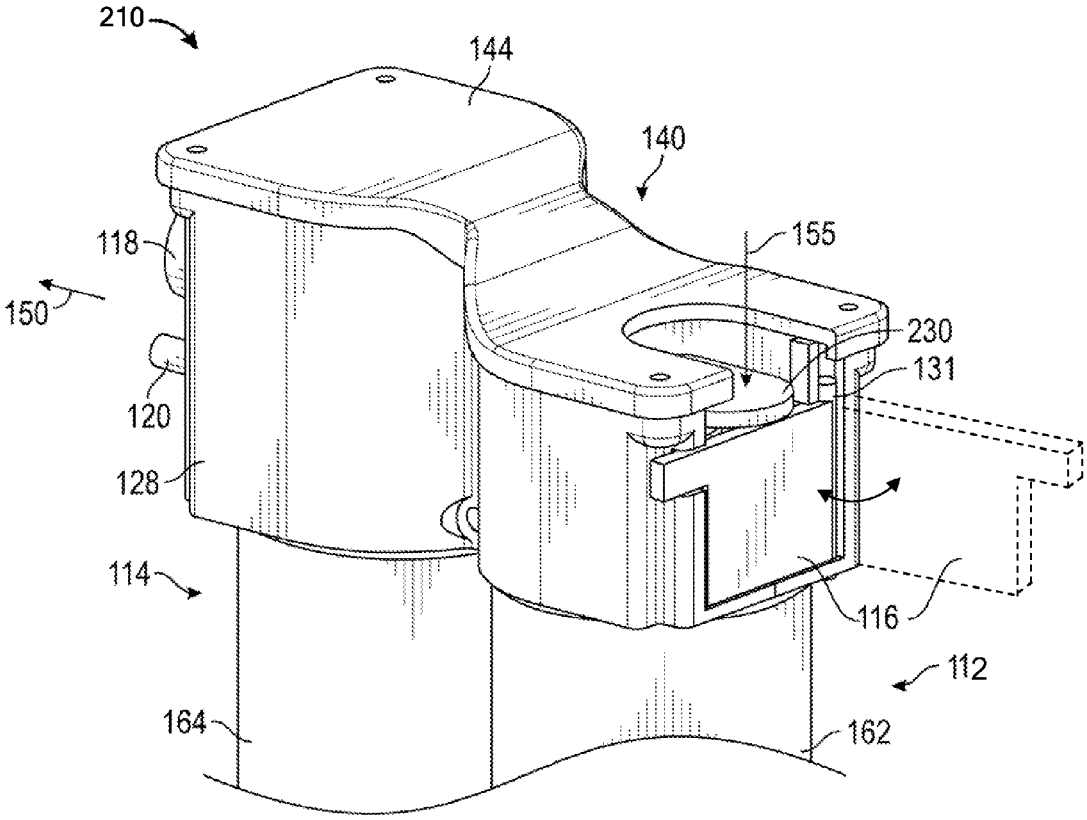
FIG. 7 shows a perspective view of the top portion of self-defense device 210 of FIG. 5, with coupling piece cover 144 in place.
Figure 8:
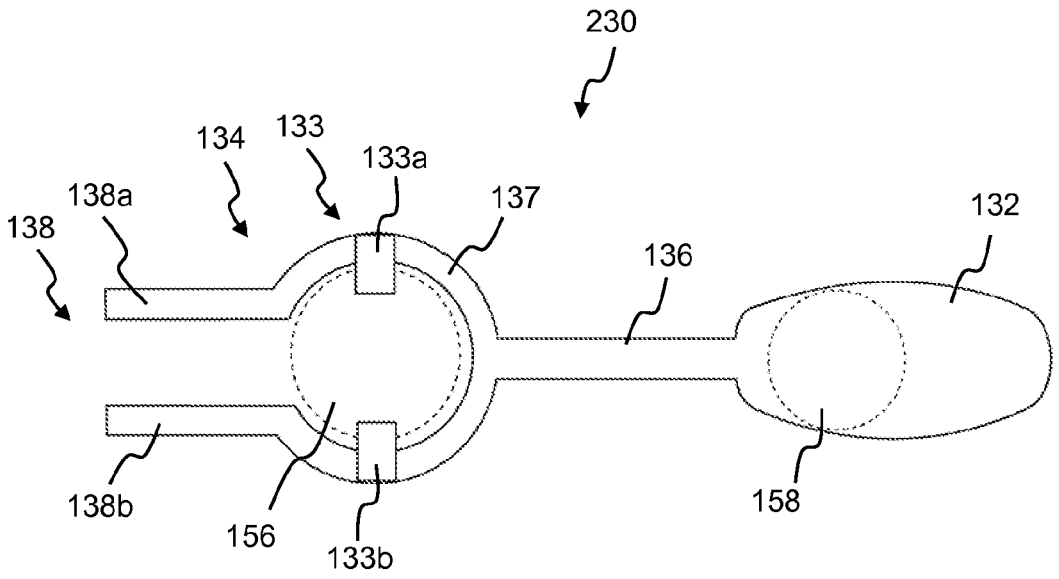
FIG. 8 shows a top view of an embodiment of trigger 230 of self-defense device 210 of FIG. 5.
Figure 9:
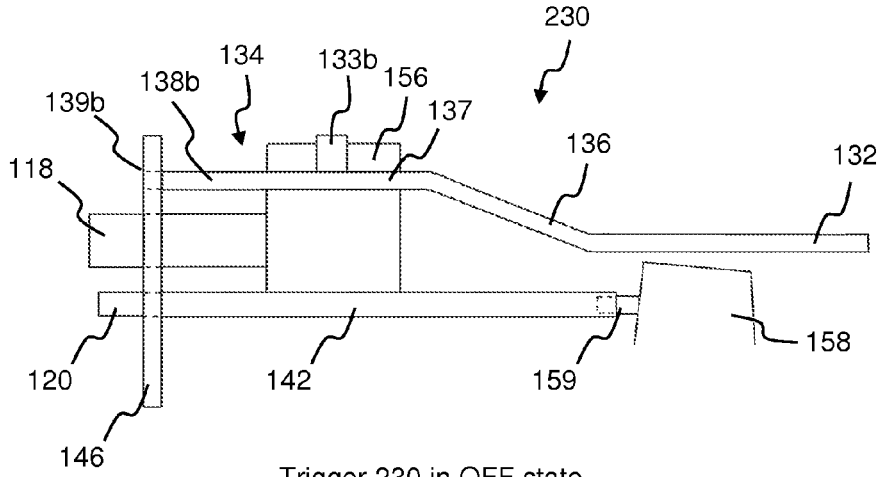
FIG. 9 shows a side cutaway view of the top portion of self-defense device 210 of FIG. 5, with many of the pieces not shown for clarity. Shown is trigger 230 in the OFF state.
Figure 10:
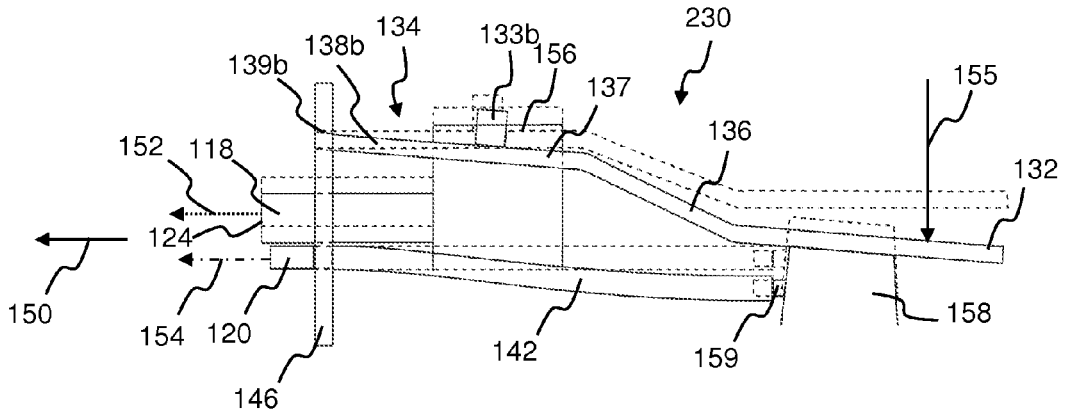
FIG. 10 shows a side cutaway view of the top portion of self-defense device 210 of FIG. 5, with many of the pieces not shown for clarity. Shown is trigger 230 in the ON state.

FIG. 5 through FIG. 10 illustrate an embodiment of self-defense device 210 according to the invention. FIG. 5 shows a perspective view of an embodiment of self-defense device 210 according to the invention. FIG. 6 shows a perspective view of self-defense device 210 of FIG. 5, with a part of coupling device 140 cut away to show further details. FIG. 7 shows a rear perspective view of self-defense device 210 of FIG. 5. FIG. 8 shows a top view of trigger 230 of self-defense device 210 of FIG. 5. FIG. 9 and FIG. 10 are side views of trigger 230 of self-defense device 210 of FIG. 5. FIG. 9 shows trigger 230 in an OFF state, and FIG. 10 shows trigger 230 in an ON state.

Self-defense device 210 of FIG. 5 through FIG. 10 includes defense unit 112 and alert unit 114. Self-defense device 210 also includes trigger 230 (see FIG. 8 through FIG. 10, to be discussed shortly) which activates both defense unit 112 and alert unit 114. Trigger 230 has an ON state and an OFF state. Defense unit 112 is activated in response to trigger 230 being in the ON state. Alert unit 114 is activated in response to trigger 230 being in the ON state. In the embodiment shown in FIG. 5 through FIG. 10, alert unit 114 is air horn 114. Air horn 114 produces noise 152 (see FIG. 10) in response to trigger 230 being in the ON state. In the embodiment shown in FIG. 5 through FIG. 10, defense unit 112 is self-defense aerosol spray unit 112. Self-defense aerosol spray unit 112 sprays stream of self-defense aerosol 154 (see FIG. 10) in response to trigger 230 being in the ON state.

Defense unit 112 in this embodiment is self-defense aerosol spray unit 112 that includes canister 162 of self-defense aerosol. Self-defense aerosol can be tear gas, pepper spray, or other spray aerosol which repels an attacker. In some embodiments there are other ingredients mixed in with the spray repellent, such as a propellant. Defense unit 112 sprays stream of self-defense aerosol 154 (see FIG. 10) when defense unit 112 is activated (trigger 230 is in the ON state). Defense unit 112 is activated by trigger 230. Trigger 230 has an ON state and an OFF state (see FIG. 9 and FIG. 10 to be discussed shortly). Defense unit 112 is activated in response to trigger 230 being in the ON state. In some embodiments defense unit 112 is a different type of defense unit. Defense unit 112 can be a device which uses electricity to repel or disable an attacker, such an electronic discharge self-defense device 170. Defense unit 112 can be a device which mechanically repels or disables an attacker. In some embodiments defense unit 112 is another type of device which repels or disables an attacker. Defense unit 112 can be any device that operates to stop an attacker from continuing an attack.

Alert unit 114 is an alert device that provides notification to others that an emergency is occurring. In this embodiment alert unit 114 is an air horn which uses compressed air from canister 164 to make noise 152 when alert unit 114 is activated. Alert unit 114 is activated by trigger 230. Trigger 230 has an ON state and an OFF state (see FIG. 9 and FIG. 10 to be discussed shortly). Alert unit 114 is activated in response to trigger 230 being in the ON state. Often alert unit 114 will act to scare away an attacker because they do not want to be caught by others. In this embodiment alert unit 114 is air horn 114 that produces noise 152 when alert unit 114 is activated. Air horn 114 in this embodiment includes canister 164 of compressed air. In some embodiments alert unit 114 is another type of noise-making device. Alert unit 114 can also use light instead of noise, or in addition to noise, to alert others of a dangerous situation. In some embodiments alert unit 114 is a strobe light 172. In some embodiments alert unit 114 is an electronic device which sends an electromagnetic alert signal that can be received by others. Alert unit 114 can be any device that emits, send, or conveys an alert message to others informing them that help is needed.

Self-defense device 210 according to the invention of FIG. 5 through FIG. 10 includes a separate defense unit 112 and alert unit 114, that are coupled together with coupling device 140. Defense unit 112 and alert unit 114 can be off-the shelf products that are incorporated into self-defense device 210. In the embodiment shown in FIG. 5 through FIG. 10, alert unit 114 is coupled to coupling device 140, and self-defense unit 112 is coupled to coupling device 140. Self-defense device 210 in this embodiment also includes trigger 230. Trigger 230 is coupled to coupling device 140 in this embodiment. Trigger 230 is coupled to coupling device 140 because lever mounts 138*a* and 138*b* are inserted into lever mount holes 139*a* and 139*b*, as will be discussed shortly.

Coupling device 140 in the embodiment shown in FIG. 5 through FIG. 10 includes coupling piece 128, coupling piece cover 144, nozzle 120, and trigger guard 116. Coupling piece 128 and coupling piece cover 144 enclose the top portion of self-defense device 210, protecting the activation and trigger mechanism of self-defense device 210. Coupling device 140 is shown in FIG. 5 with coupling piece cover 144 removed so details of trigger 230 can be seen. FIG. 6 shows a side perspective view of the top portion of self-defense device 210 of FIG. 5, with a portion of coupling device 140 cut away to show the details of trigger 230, horn activator 156, and self-defense spray activator 158. Coupling piece 128 in this embodiment has coupling piece front portion 146, which holds nozzle 120 and horn bell 118, and which includes lever mount holes 139*a* and 139*b* (to be discussed shortly).

Coupling device 140 in the embodiment shown in FIG. 5 through FIG. 10 includes nozzle 120. Nozzle 120 is held in this embodiment by coupling piece front portion 146. Nozzle 120 is the outlet which sprays stream of self-defense spray aerosol 154 when canister of self-defense spray 112 is activated. Nozzle 120 sprays self-defense aerosol 154 in direction 150 in this embodiment. Nozzle 120 in this embodiment is coupled to aerosol passage tube 142, which is in turn coupled to self-defense spray outlet 159. Self-defense spray outlet 159 is coupled to self-defense spray activator 158. When self-defense spray activator 158 is pressed down towards canister 162, self-defense unit 112 is activated. When self-defense unit 112 is activated, self-defense aerosol is released from self-defense spray outlet 159, through aerosol passage tube 142, and out nozzle 120 as stream of self-defense aerosol spray 154.

Horn bell 118 passes through coupling piece 140 in this embodiment. Horn bell 118 releases noise 152 from horn bell orifice 124 when alert unit 114 is activated. Horn bell 118 is coupled to air horn activator 156. Air horn 114 is activated when air horn activator 156 is moved in a direction towards canister 164. When air horn activator 156 is pressed down towards canister 164, noise 152 is released from horn bell 118 in direction 150.

Coupling device 140 in this embodiment also includes trigger guard 116. Trigger guard 116 swings on axle 131 (see FIG. 7) between an engaged state and a disengaged state. Trigger guard 116 is in an engaged state when trigger guard 116 is closed, as shown in FIG. 5, FIG. 6, and in FIG. 7 in solid lines. When trigger guard 116 is in an engaged state as shown in FIG. 7 in solid lines, trigger guard 116 prevents trigger 230 from being placed in an ON state. Trigger guard 116 prevents trigger 230 from being placed in the ON state by preventing trigger 230 from moving downwards when pressure 155 is put on trigger 230. Trigger guard 116 prevents trigger 230 from moving downwards when trigger guard 116 is in an engaged state by preventing the downward movement of trigger 230. Trigger 230 hits trigger guard 116 when trigger guard 116 is in the engaged state, and thus trigger 230 is not able to move downward to activate self-defense unit 112 or alert unit 114.

Trigger guard 116 swings like a door on axle 131 to move from the engaged state to the disengaged state. Trigger guard 116 in a disengaged state is shown in dotted lines in FIG. 7. When trigger guard 116 is in a disengaged state, trigger 230 is able to move downwards in response to pressure 155. When trigger guard 116 is in a disengaged state, trigger 230 moves downwards due to pressure 155, placing trigger 230 in the ON state. Thus when trigger guard 116 is in a disengaged stated, trigger guard 116 does not prevent trigger 230 from being placed in the ON state.

Coupling device 140 in this embodiment positions nozzle 120 and horn bell 118 so that both horn blast noise 152 from air horn 114 and stream of self-defense aerosol spray 154 from self-defense aerosol spray unit 112 are directed in predetermined direction 150. In this embodiment both horn blast noise 152 and stream of aerosol spray 154 are directed in the same predetermined direction 150 so they both can be simultaneously directed towards an attacker.

Self-defense device 210 in the embodiment shown in FIG. 5 through FIG. 10 also includes trigger 230. Trigger 230 can be many different types of triggering mechanisms with an ON state and an OFF state. In this embodiment trigger 230 is a mechanical trigger that is pressure-activated. Trigger 230 is in an OFF state as shown in FIG. 9 when it does not have pressure 155 applied. Trigger 230 can be placed in an ON state as shown in FIG. 10, when pressure 155 is applied and trigger guard 116 is in the disengaged state.

FIG. 8 shows a top view of trigger 230 of self-defense device 210 of FIG. 5 through FIG. 10. Trigger 230 in this embodiment includes first trigger portion 132, second trigger portion 134, and trigger portion coupler 136. FIG. 8 shows horn activator 156 and self-defense spray activator 158 in dotted lines, showing how first trigger portion 132 sits above self-defense spray activator 158, and that second trigger portion 134 has tabs 133*a* and 133*b* which sit above horn activator 156. FIG. 9 shows a side view of trigger 230 in the OFF state, as well as the activating parts of self-defense device 210, with other components of device 210 not shown for clarity. FIG. 10 shows a side view of trigger 230 in the ON state, as well as the activating parts of self-defense device 210, with other components of device 210 not shown for clarity. In FIG. 10, trigger 230 and the activating components in the OFF state from FIG. 9 are shown in dotted lines for reference.

Trigger 230 places self-defense device 210 in the ON state in response to trigger 230 receiving pressure 155. First trigger portion 132 places self-defense aerosol spray unit 112 in the ON state in response to first trigger portion 132 receiving pressure 155. First trigger portion 132 sits above self-defense spray activator 156, as shown in FIG. 8, FIG. 9, and FIG. 10. When trigger guard 116 is in the disengaged state, pressure 155 on first trigger portion 132 presses first trigger portion 132 down, placing trigger 230 in the ON state, as shown in FIG. 10. Pressure 155 on first trigger portion 132 pushes self-defense spray activator 158 down, placing self-defense unit 112 in the activated state, which results in stream of self-defense aerosol 154 being released from nozzle 120. Pressure 155 is often supplied by a finger on first trigger portion 132. It is to be understood that when trigger guard 116 is in the engaged state, first trigger portion 132 cannot be moved to place self-defense device 210 or self-defense unit 112 in the ON state (it is prevented from moving by trigger guard 116).

Trigger portion coupler 136 in this embodiment mechanically couples second trigger portion 134 to first trigger portion 132. Trigger portion coupler 136 in this embodiment is a mechanical arm that fixedly mechanically couples second trigger portion 134 and first trigger portion 132. Thus when first trigger portion 132 moves downward in response to pressure 155, second trigger portion 134 moves downward in response to first trigger portion 132 moving downward. In some embodiments trigger portion coupler 136 takes other forms.

Thus second trigger portion 134 places air horn 114 in the ON state in response to first trigger portion 132 receiving pressure 155. Second trigger portion 134 in this embodiment includes semi-annular ring 137, and lever mount 138. Semi-annular ring 137 in this embodiment encircles a part of the diameter of horn activator 156. A semi-annular ring as used in this document describes an annular ring which is a portion of a full circle. In this embodiment semi-annular ring 137 partially encircles horn activator 156. Semi-annular ring in this embodiment includes tab 133, which includes first tab 133*a*, and second tab 133*b*. Semi-annular ring 137 is coupled to trigger portion coupler 136, such that when first trigger portion 132 moves downward in response to pressure 155, semi-annular ring 137 moves downward also, as shown in FIG. 10. Semi-annular ring 137 includes first and second tabs 133*a* and 133*b*. First and second tabs 133*a* and 133*b* moved downward with semi-annular ring 137. First and second tabs 133*a* and 133*b* put pressure on horn activator 156 when semi-annular ring 137 moves downward. The downward movement of semi-annular ring 137 causes tabs 133*a* and 133*b* to move horn activator 156 downward, which activates air horn 114. Air horn 114 releases noise 152 in direction 150 from air horn bell 118 in response to air horn 114 being activated. Thus second trigger portion 134 places air horn 114 in the ON state in response to first trigger portion 132 receiving pressure 155.

Trigger 230 also includes lever mount 138. Lever mount 138 couples trigger 230 to coupling device 140 in this embodiment. Lever mount 138 in this embodiment includes lever mount 138*a* and lever mount 138*b*. Lever mounts 138*a* and 138*b* are fixedly coupled to semi-annular ring 137 such that lever mounts 138*a* and 138*b* move with semi-annular ring 137. Lever mounts 138*a* and 138*b* couple trigger 230 to coupling device 140. Lever mounts 138*a* and 138*b* are inserted into lever mount holes 138*a* and 138*b* in coupling piece front piece 146. Lever mount 138*a* inserts into lever mount hole 139*a*, and lever mount 138*b* inserts into lever mount hole 139*b*. Lever mounts 138*a* and 138*b* are inserted into and are held by lever mount holes 139*a* and 139*b* such that lever mounts 138*a* and 138*b* can move slightly to accommodate the movement of trigger 230 as it moves up and down between the ON state and the OFF state.

As explained above, when pressure 155 is put on trigger 230, pushing trigger 230 down towards canisters 162 and 164, trigger 230 is placed in an ON state as shown in FIG. 10, which activates alert unit 114 and defense unit 112. In this embodiment trigger 230 stays in an ON state as long as pressure 155 remains on trigger 230. Pressure 155 is usually applied with a finger on the top of trigger 230. When pressure 155 is released, trigger 230 returns to an OFF state in this embodiment. Trigger 230 can be engaged in many other different ways, depending on the type of trigger 230 used. In some embodiments trigger 230 is put in an ON state with pressure, and then stays in the ON state even when the pressure is removed. In some embodiments trigger 230 requires pressure in another direction to move trigger 230 from an ON state to an OFF state.

In the embodiment shown in FIG. 5 through FIG. 10, trigger 230 is a mechanical trigger. In some embodiments trigger 230 is an electrical trigger. Trigger 230 can be any type of triggering mechanism with at least two states, an ON state and an OFF state, where alert unit 114 and defense unit 112 are activated in response to trigger 230 being in the ON state.

Trigger 230 of self-defense device 210 is placed in the ON state when an attack or other emergency occurs. If the user of self-defense device 210 is being attacked, the user can hold self-defense device 210 such that direction 150 is pointing at the attacker, and place trigger 230 in the ON state. Self-defense aerosol spray unit 112 will spray stream of self-defense aerosol 154 in direction 150, which will disable or deter the attacker from continuing the attack. Air horn 114 will direct horn blast noise 152 in direction 150, which will startle the attacker, and draw attention from others so that the attacker will be unable or unwilling to continue the attack.

The combination of the self-defense aerosol directed at the attacker and the air horn attracting attention is intended to stop the attack.

Figure 11:
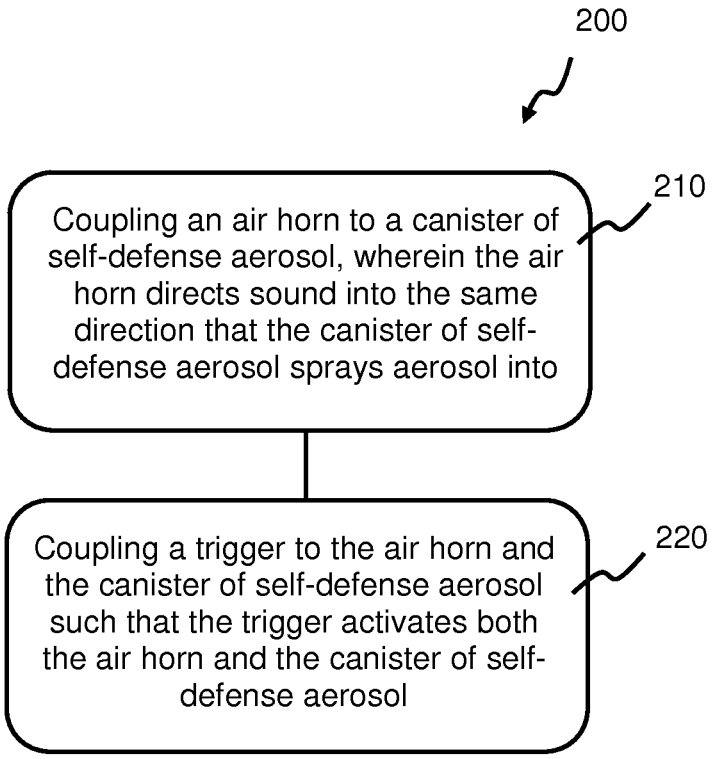
FIG. 11 shows method 200 of forming a self-defense device according to the invention.

FIG. 11 illustrates method 200 of forming a self-defense device, where method 200 includes step 210 coupling an air horn to a self-defense aerosol spray unit, wherein the air horn directs sound into the same direction that the self-defense aerosol spray unit sprays aerosol into. Method 200 also includes step 220 coupling a trigger to the air horn and the self-defense aerosol spray unit such that the trigger activates both the air horn and the self-defense aerosol spray unit. Method 200 can include many other steps. In some embodiments method 200 includes the step of coupling a marking unit to the self-defense aerosol spray unit, where the marking unit is also activated by the trigger. In some embodiments a marking material is included in with the self-defense aerosol spray unit such that the marking material sprays with the self-defense spray. In some embodiments method 200 includes the step of coupling a camera to the self-defense device.

Step 210 coupling an air horn to a self-defense aerosol spray unit, includes any steps involved in coupling an air horn to a self-defense aerosol spray unit such that the sound blast from the air horn and the aerosol spray from the self-defense aerosol spray unit are both directed in the same direction. In some embodiments step 210 includes mounting a nozzle from a self-defense aerosol spray unit such that it points in a predetermined direction. In some embodiments step 210 includes mounting an air horn bell from an air horn such that it points the in same predetermined direction. In some embodiments step 210 includes other steps. In some embodiments step 210 includes coupling the air horn to the self-defense aerosol spray unit with a top coupling device. In some embodiments the top coupling device includes the air horn bell. In some embodiments the top coupling device includes the nozzle. In some embodiments the top coupling device includes a trigger guard.

Step 220 coupling a trigger to the air horn and the self-defense aerosol spray unit such that the trigger activates both the air horn and the self-defense aerosol spray unit, can include many steps. In some embodiments step 220 includes coupling a trigger to the air horn and the self-defense aerosol spray unit, wherein the trigger has an ON state and an OFF state, and wherein both the air horn and the self-defense aerosol spray unit are activated in response to the trigger being in the ON state. In some embodiments the trigger is mounted to a top coupling device. In some embodiments the top coupling device includes a trigger guard. In some embodiments the trigger guard only allows access to the trigger from one direction.

Figure 12:
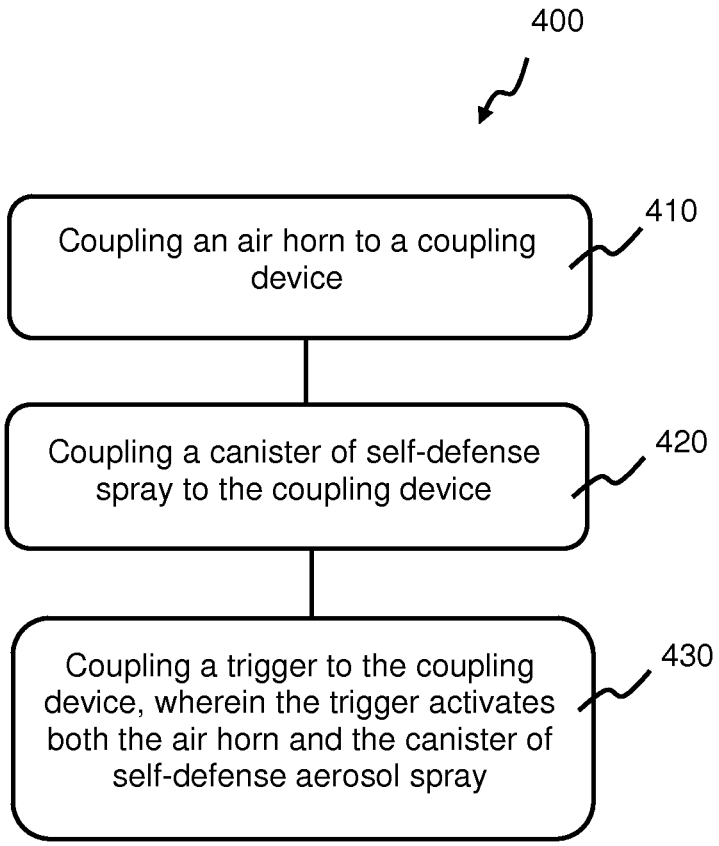
FIG. 12 shows method 400 of forming a self-defense device according to the invention.

FIG. 12 illustrates method 400 of forming a self-defense device. Method 400 includes step 410 of coupling an air horn to a coupling device, step 420 of coupling a canister of self-defense aerosol spray to the coupling device, and step 430 of coupling a trigger to the coupling device, where the trigger activates both the air horn and the canister of self-defense aerosol spray. Method 400 can include many other steps. In some embodiments method 400 includes the step of coupling a camera to the coupling device, such that the trigger activates the camera.

In some embodiments step 420 of coupling a canister of self-defense aerosol spray to a coupling device includes coupling a canister of self-defense aerosol spray to a coupling device such that the canister of self-defense aerosol spray directs a stream of self-defense aerosol spray into a predetermined direction in response to the canister of self-defense aerosol spray being activated. In some embodiments the step of coupling an air horn to a coupling device includes coupling an air horn to a coupling device such that the air horn directs noise into a predetermined direction in response to the air horn being activated.

In some embodiments method 400 includes the step of forming a trigger. In some embodiments the step of forming a trigger includes forming a first trigger portion, forming a second trigger portion, and forming a trigger portion coupler, wherein the trigger portion coupler couples the second trigger portion to the first trigger portion. In some embodiments the step of forming a second trigger portion includes the steps of forming a semi-annular ring, wherein the semi-annular ring is coupled to the trigger portion coupler, forming a first tab, wherein the first tab is coupled to the semi-annular ring, forming a second tab, wherein the second tab is coupled to the semi-annular ring, and forming a lever mount, wherein the lever mount is coupled to the semi-annular ring, and wherein the lever mount couples the trigger to the coupling device.

Figure 13:
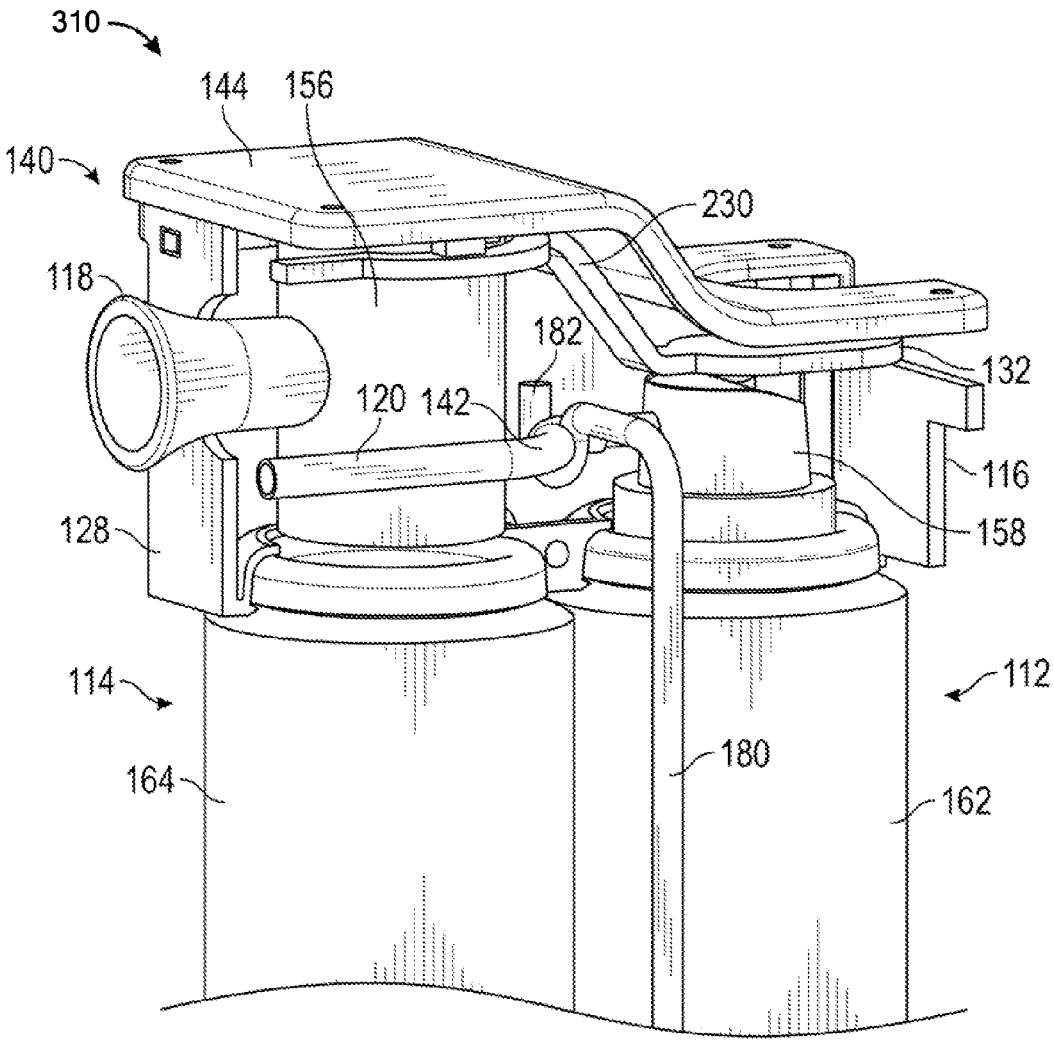
FIG. 13 shows a perspective view of a further embodiment of self-defense device 310 according to the invention
Figure 14:
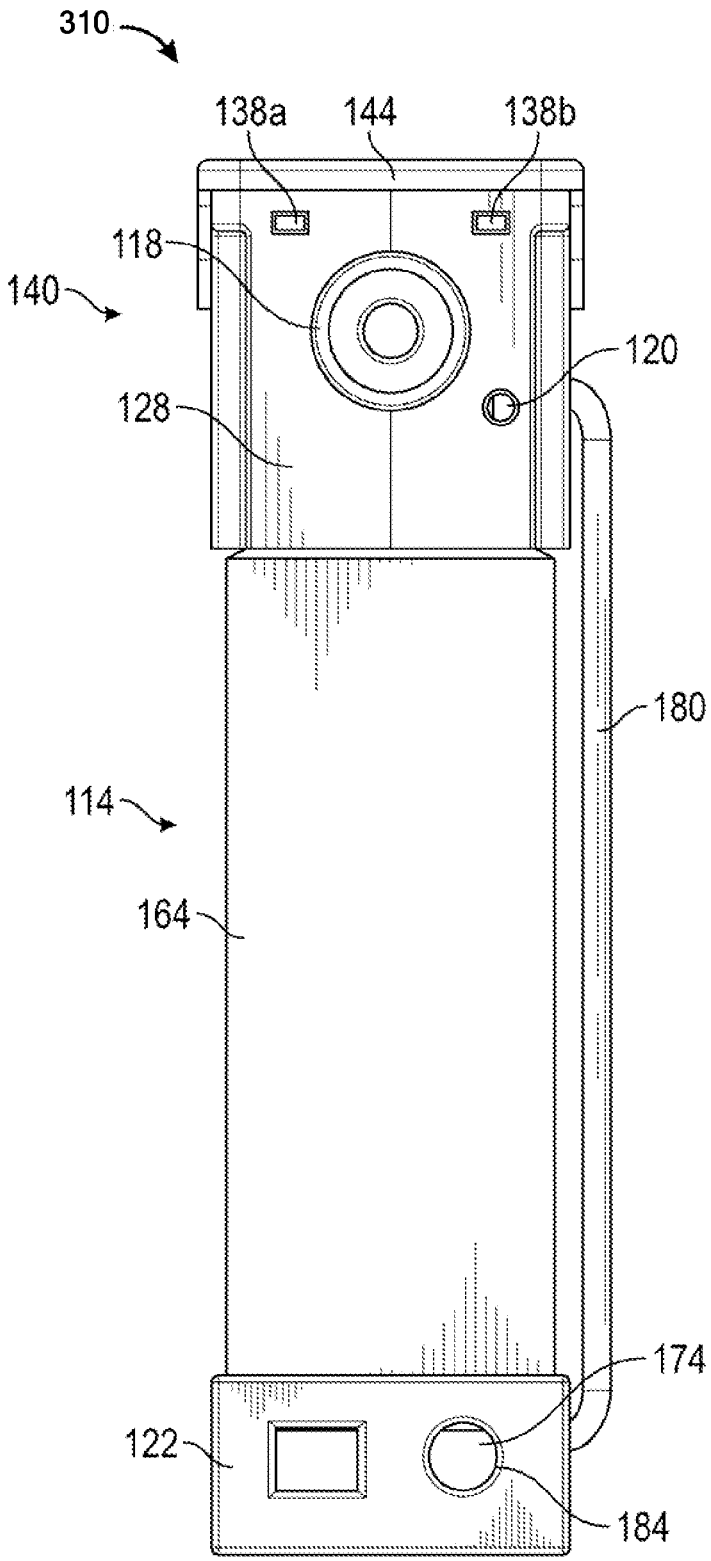
FIG. 14 shows a front view of self-defense device 310 of FIG. 13, with camera trigger extender 180, camera port 184, and camera 174.

FIG. 13 and FIG. 14 show perspective and front views, respectively, of an embodiment of self-defense device 310. In this embodiment self-defense device 310 includes camera 174 in bottom coupling piece 122. Camera 174 snaps pictures and/or videos through camera port 184. In this embodiment camera 174 is pointed in direction 150 such that when camera 174 is activated, camera 174 captures a picture in direction 150. In this way camera 174 can capture a picture or a video of an attack or an attacker that may be useful in identifying, capturing, and/or prosecuting an attacker.

Camera 174 is activated by trigger 230 in this embodiment. In this embodiment camera 174 is activate by trigger 230 using camera trigger extender 180. Camera trigger extender 180 is coupled to camera 174 such that movement of camera trigger extender 180 activates camera 174—causes camera 174 to capture a picture or video, The other end of camera trigger extender 180 is coupled to aerosol passage tube 142 as shown in FIG. 13. Camera trigger extender 180 includes trigger extender coupler 182, which couples camera trigger extender 180 to aerosol passage tube 142. In this embodiment trigger extender coupler 182 is a hook which hooks camera trigger extender 180 onto aerosol passage tube 142. When trigger 230 receives pressure and moves downward, activating defense unit 112 and alert unit 114, aerosol passage tube 142 moves downward also, as shown in FIG. 10. The downward movement of aerosol passage tube 142 moves trigger extender coupler 182 and camera trigger extender 180 downward. This downward movement of camera trigger extender 180 activates camera 174. Thus trigger 230 activates camera 174. In some embodiments trigger 230 activates camera 174 using other means or devices.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above.

What is claimed is:

1. A self-defense device comprising:

a trigger with an ON state and an OFF state;

an air horn, wherein the air horn produces a noise in response to the trigger being in the ON state;

a self-defense aerosol spray unit, wherein the self-defense aerosol spray unit sprays a stream of self-defense aerosol in response to the trigger being in the ON state; and a coupling device, wherein the coupling device couples the air horn to the self defense aerosol spray unit, wherein the coupling device comprises a nozzle, a trigger guard, a coupling piece and a coupling piece cover;

wherein the trigger comprises:

a first trigger portion, wherein the first trigger portion places the self-defense aerosol spray unit in the ON state in response to the first trigger portion receiving pressure;

a second trigger portion, wherein the second trigger portion places the air horn in the ON state in response to the first trigger portion receiving pressure; and a trigger portion coupler, wherein the trigger portion coupler mechanically couples the first trigger portion to the second trigger portion;

wherein the second trigger portion comprises:

a semi-annular ring coupled to the trigger portion coupler, wherein the semi-annular ring comprises:

a first tab;

and a second tab;

wherein the first tab and the second tab place the air horn in the ON state in response to the first trigger portion receiving pressure;

and a lever mount coupled to the semi-annular ring, wherein the lever mount couples the trigger to the coupling device.

2. The self-defense device of claim 1, wherein the stream of self-defense aerosol is sprayed from the nozzle;

and wherein the trigger guard swings on an axle to move from an engaged state to a disengaged state, and wherein the trigger guard prevents the trigger from being placed in the ON state in response to the trigger guard being in an engaged state.

3. The self-defense device of claim 1, wherein a horn bell directs the noise in a predetermined direction, and wherein the nozzle sprays self-defense aerosol in the predetermined direction.

4. The self-defense device of claim 3, further including a canister of marking material aerosol, wherein the canister of marking material aerosol sprays marking material into the predetermined direction in response to the trigger being in the ON state.

5. A self-defense device comprising:

a defense unit;

an alert unit;

a coupling device comprising a nozzle, a trigger guard, a coupling piece and a coupling piece cover, wherein the coupling device couples the defense unit to the alert unit; and a trigger, wherein the trigger comprises:

a first trigger portion, wherein the first trigger portion activates the defense unit;

a second trigger portion, wherein the second trigger portion activates the alert unit;

a trigger portion coupler, wherein the trigger portion coupler couples the second trigger portion to the first trigger portion; and a lever mount, wherein the lever mount is inserted into a lever mount hole in the coupling device;

wherein the second trigger portion comprises:

a semi-annular ring coupled to the trigger portion coupler, wherein the semi-annular ring comprises:

a first tab;

and a second tab;

wherein the first tab and the second tab place the air horn in the ON state in response to the first trigger portion receiving pressure;

and a lever mount coupled to the semi-annular ring, wherein the lever mount couples the trigger to the coupling device.

6. The self-defense device of claim 5, wherein the defense unit comprises a canister of self-defense aerosol spray.

7. The self-defense device of claim 5, wherein the defense unit comprises an electronic discharge self-defense device.

8. The self-defense device of claim 5, wherein the alert unit comprises an air horn.

9. The self-defense device of claim 5, wherein the alert unit comprises a strobe light.

10. The self-defense device of claim 5, wherein the coupling device comprises a camera, wherein the trigger activates the camera.

11. A method of forming a self-defense device, the method comprising the steps of:

coupling an air horn to a coupling device comprising a nozzle, a trigger guard, a coupling piece and a coupling piece cover;

coupling a canister of self-defense aerosol spray to the coupling device;

and coupling a trigger to the coupling device, wherein the trigger activates both the air horn and the canister of self-defense aerosol spray, wherein the trigger comprises:

a first trigger portion, wherein the first trigger portion activates the defense unit;

a second trigger portion, wherein the second trigger portion activates the alert unit;

a trigger portion coupler, wherein the trigger portion coupler couples the second trigger portion to the first trigger portion; and a lever mount, wherein the lever mount is inserted into a lever mount hole in the coupling device;

wherein the second trigger portion comprises:

a semi-annular ring coupled to the trigger portion coupler, wherein the semi-annular ring comprises:

a first tab;

and a second tab;

wherein the first tab and the second tab place the air horn in the ON state in response to the first trigger portion receiving pressure;

and a lever mount coupled to the semi-annular ring, wherein the lever mount couples the trigger to the coupling device.

12. The method of claim 11, wherein the step of coupling the air horn to the coupling device comprises coupling the air horn to the coupling device such that the air horn directs noise into a predetermined direction in response to the air horn being activated.

13. The method of claim 11, further comprising the step of coupling a camera to the coupling device, wherein the trigger activates the camera.

* * * * *